United States Patent [19]

Hash

[11] Patent Number: 4,823,096

[45] Date of Patent: Apr. 18, 1989

[54] VARIABLE RATIO POWER DIVIDER/COMBINER

[75] Inventor: Ronald J. Hash, Palm Bay, Fla.

[73] Assignee: Harris Corporation, Melbourne, Fla.

[21] Appl. No.: 141,758

[22] Filed: Jan. 11, 1988

[51] Int. Cl.[4] ..... H01P 5/04

[52] U.S. Cl. ..... 333/109; 333/117; 333/136

[58] Field of Search ..... 333/109, 111, 115–117, 333/123–129, 132, 134, 101, 103, 104, 136; 307/320

[56] References Cited

U.S. PATENT DOCUMENTS

| | | | |
|---|---|---|---|
| 3,233,195 | 2/1966 | Barraclough | 333/104 |
| 3,293,644 | 12/1966 | Loos et al. | 333/124 X |
| 3,503,014 | 3/1970 | Hall et al. | 333/104 |
| 4,394,629 | 7/1983 | Kumar et al. | 333/109 |
| 4,463,326 | 7/1984 | Hom | 333/128 |
| 4,480,338 | 10/1984 | Dobrovolny | 333/132 X |
| 4,485,362 | 11/1984 | Campi et al. | 333/128 |
| 4,556,808 | 12/1985 | Coats | 333/103 X |
| 4,556,856 | 12/1985 | Presser | 333/124 |
| 4,559,489 | 12/1985 | Vacanti et al. | 333/1.1 |
| 4,583,061 | 4/1986 | O'Shea | 333/116 |

OTHER PUBLICATIONS

Nyström, *A New Microwave Power Divider*, IEEE Trans. on MTT, vol. MTT-27, No. 1, Jan. '79, pp. 89,90.

Low Loss Electronically Controlled EHF Variable Power Dividers by Besse & Sharon, 1983 IEEE MTT-S Digest.

*Primary Examiner*—Paul Gensler

*Attorney, Agent, or Firm*—John L. DeAngelis, Jr.; Dennis L. Cook

[57] ABSTRACT

A variable ratio power divider/combiner includes first and second resonant circuits connected between the input port and the two output ports in the divider configuration. The signals appear at an output port of the divider as determined by the resonant condition of the resonant circuits. The resonance condition is controlled by a control signal that varies a capacitance in the resonant circuit.

17 Claims, 4 Drawing Sheets

VARIABLE RATIO POWER DIVIDER/COMBINER

FIELD OF THE INVENTION

This invention relates to power divider networks having a planar configuration for providing variable dividing/combing power ratios.

BACKGROUND OF THE INVENTION

In certain types of signal transmission systems, such as communications satellites, it is necessary to couple energy from a plurality of microwave signal sources to a single output port. Waveguide-based systems use various types of variable ratio power combiners that operate essentially as variable directional couplers providing selective coupling from zero to 100%. One such waveguide-type variable ratio power combiner is described and claimed in U.S. Pat. No. 4,492,938, which is assigned to the assignee of the present invention. This device provides the variable combining feature by mechanical adjustment of its waveguide components.

Recent advances in solid state technology have made it possible to replace, at some frequencies, vacuum tube high-power amplifiers with solid-state high power amplifiers. Although the solid state high power amplifiers provide higher reliability, they have sharply limited power handling capabilities, compared to vacuum tube high power amplifiers. Accordingly, power combiner circuits are used with the solid state devices to provide suitably high levels of power transmission.

A schematic block diagram of a typical solid-state high power amplifier is shown in FIG. 1 as containing the following principal elements: a power divider section 12, a solid state amplifier section 13, and a power combiner section 14, coupled in cascade between an input port 11 and an output port 15. In general, the power combiner section 14 is a replica of the power divider section 12, except for higher power physical considerations. The number of individual amplifier modules 13-1 . . . 13-N will depend upon the capacity of a single module 13-i, the total output required, and the losses through the power divider section 12 and the power combiner section 14. There are many types of signalling and coupling hardware that can be used for the divider and combiner sections illustrated in FIG. 1. Included among these couplings schemes are stripline networks using Wilkinson type dividers, waveguide or coaxial networks using 3 dB quad couplers, ratio combiners having a center coaxial probe, and ratio coaxial feed probes contained within a parallel plate structure.

A prior art 3 dB hybrid directional coupler 16 is illustrated in FIG. 2; the coupler 16 can be implemented in microstrip or stripline. When a signal is provided as an input to a egment 17, the segment 18 is isolated, i.e., no part of the input signal appears at the isolated segment 18. A segment 19 carries one-half of the input signal from the segment 17 with a relative output phase of 0° and a segment 20 carries one-half of the input signal with a relative output phase of 90°. As can be seen, a connecting segment 21 bridges the segments 17 and 19 with the segments 18 and 20.

The prior art microwave power dividers, such as those mentioned above, are individually designed and constructed to achieve specific fixed divisions of the input microwave power at the output ports. Once one of these microwave power dividers has been designed and constructed to achieve a specific power split, it cannot later be easily changed to give a different power split. For example, if a magic T or hybrid coupler has been designed and constructed to achieve a 3/3 dB power split in which one-half of the input power is seen at each of the two output ports, it cannot thereafter be changed to achieve a 6/1.25 dB, in which one-fourth and three-fourths of the input power is seen at the two output ports.

A prior art circulator 36, which can provide limited power combining/dividing, is illustrated in FIG. 3. The circulator 36 has 3 ports designated by reference characters 38, 40, and 42. The application of a static external magnetic field allows an input signal at one port to be reflected to an output at a different port. For example, when a signal is input to port 38 the output signal appears at port 42, and port 40 is isolated. When a signal is provided as an input to the port 42, the output signal appears at the port 40 and port 38 is isolated. Lastly, when a signal is provided as in input to port 40, the output signal appears at port 38, and port 42 is isolated. The circulator 36 is not a power-efficient device, but it can be electromagnetically adjusted to provide limited power division among the ports. Limited power division around a nominal value can be obtained by adjusting the magnetic field intensity orthogonal to the circulator substrate. Power division can also be accomplished by connecting a variable impedance between one port of the circulator 36 and ground. Changing this impedance value will change the power ratios.

SUMMARY OF THE INVENTION

The objective of the present invention is to provide a monolithic power divider (or combiner) that provides variable power division, thus overcoming the disadvantages of the prior art variable ratio power dividers discussed above. The variable ratio power divider of the present invention is controlled by a control voltage that varies the impedance of a resonant inductor-varactor circuit. The impedance of the resonant circuit is adjustable to impedances ranging from a short circuit to an open circuit to split the input power between the two output ports.

BRIEF DESCRIPTION OF THE DRAWINGS

The present invention can be more easily understood, and the further advantages and uses thereof more readily apparent, when considered in view of the description of the preferred embodiments and the following figures in which.

DESCRIPTION OF THE PREFERRED EMBODIMENTS

Figure 4:
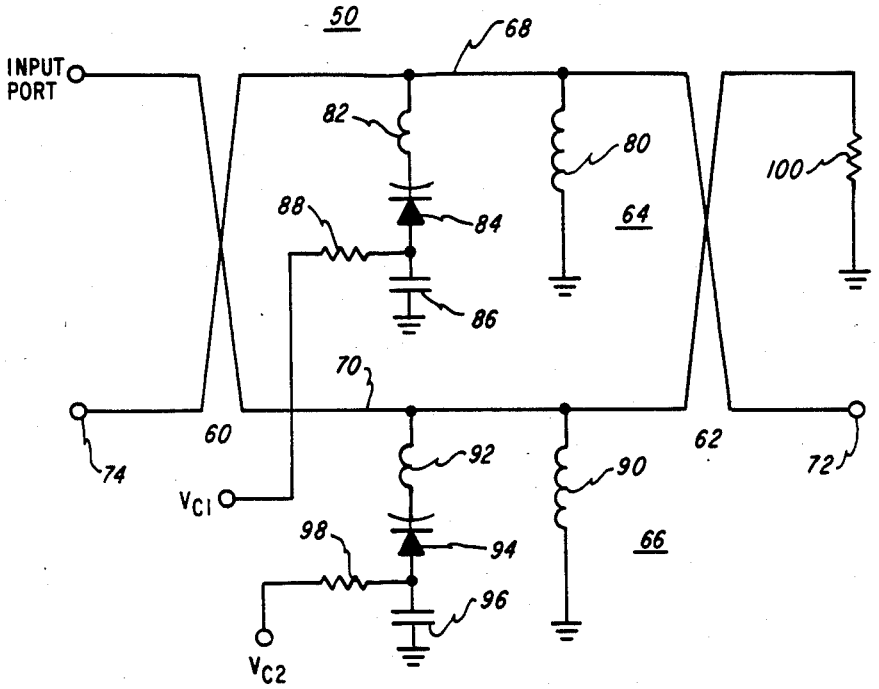
FIGS. 4 and 5 illustrate, in schematic form, two embodiments of the variable ratio power divider of the present invention.

FIG. 4 illustrates a variable ratio power divider 50 constructed according to the teachings of the present invention. The variable ratio power divider 50 includes two resonant circuits designated by reference characters 64 and 66. The signal provided at the input port is divided by a quadrature 3 dB hybrid coupler 60 so that one-half of the signal (at a relative 0° phase angle) appears on a signal conductor 68 and one-half (at a relative 90° phase angle) appears on a signal conductor 70. When the resonant circuits 64 and 66 are in parallel resonance both appear as open circuits causing the signals on the signal conductors 68 and 70 to be combined in a quadrature 3 dB hybrid coupler 62, with the resultant signal appearing at a port 72, with a phase angle of −180° relative to the input signal. Although the couplers 60 and 62 are shown as quadrature 3 dB hybrid couplers, any equal-power split coupler can be used in place thereof. For example, antiphase 3 dB hybrid couplers, which provide equal power division but with relative phases of 0° and 180°, can be substituted.

When both the resonant circuits 64 and 66 are in series resonance, each appears as a short circuit between ground and the conductors 68 and 70, respectively, and thus all the power from the input port is reflected back to a port 74. In this condition the resultant signal at the port 74 is 180° out of phase with respect to the signal at the input port. When the impedances of the resonant circuits 64 and 66 are between a short circuit and an open circuit there is a division of power, as determined by the impedances of the resonant circuits 64 and 66 relative to the characteristic impedance of the signal conductors 68 and 70. Thus, a portion of the power appears at the output port 72 and a portion of the power appears at the output port 74.

The resonant circuit 64 comprises a series connection of an inductor 82, a varactor, 84, and a capacitor 86. This series combination is connected between the signal conductor 68 and ground and is also connected in parallel with an inductor 80. The connection point between the varactor 84 and the capacitor 86 is connected to a control voltage $V_{C1}$ through a resistor 88. The inductor 82 has a small inductance relative to the inductor 80., in one embodiment the inductor 82 is a parasitic inductance of the varactor 84. When the capacitance of the varactor 84 is large it resonates with the inductor 82 to create a series resonant short circuit. When the capacitance of the varactor 84 is small a parallel resonant circuit is created with the inductor 80, creating an open circuit. The control voltage $V_{C1}$ is applied to the varactor 84 to control the capacitance thereof and thereby create the open or the short circuit (or any impedance between these extremes) as discussed above.

The capacitor 86 is of a relatively large value to provide dc blocking, but appears as a low impedance, compared to the capacitor 84, at the high frequencies at which the variable ratio power divider operates. Thus, the capacitor 86 does not substantially affect the operation of the resonant circuit 64.

The resonant circuit 66 includes an inductor 90 connected between the signal conductor 70 and ground. The resonant circuit 66 also includes a series combination of an inductor 92, a varactor 94, and a capacitor 96, connected between the signal conductor 70 and ground. The connection point between the varactor 94 and the capacitor 96 is connected to a control voltage $V_{C2}$ via a resistor 98. The resonant circuit 66 functions identically to the resonant circuit 64.

The variable ratio power divider 50 also includes a load resistor 100 that is matched to the transmission line (i.e., the signal conductors 68 and 70) impedance, which in one embodiment is 50 ohms. The resistors 88 and 98 in addition to serving as dc bias resistors, also provide RF blocking into the control voltage source. In one embodiment the resistors 88 and 98 are 2,000 ohms, but in another embodiment RF chokes can also be substituted. Also in one embodiment, the inductors 80 and 90 can be formed from a length of high impedance transmission line, rather than using a discrete inductor. This feature enables implementation of the variable ratio power divider in monolithic form.

When the inductor 82 and the varactor 84 are in series resonance (the inductor 80 has no effect under this condition) the signal conductor 6B appears as a short circuit and thus no energy is propagated beyond the resonant circuit 64. Instead, the energy is reflected back to the quadrature 3 dB hybrid 60 and thus to the port 74. When the varactor 84 and the inductor 80 are in parallel resonance the resonant circuit 64 appears as an open and all the power propagating on the signal conductor 68 is passed to the 3 db hybrid coupler 62, and thus to the port 72. Because the inductor 82 has a small inductance compared with the indicator 84, the former inductance can be disregarded in this situation. Operation of the resonant circuits 64 and 66 at an intermediate impedance value provides the mechanism by which the ratio between the output power at the ports 72 and 74 is varied. Control of the resonant circuits 64 and 66 is accomplished separately (with $V_{C1}$ and $V_{C2}$) and with virtually no dc power consumption. For optimum performance $V_{C1}=V_{C2}$ and the resonant circuits 64 and 66 are matched. This provides low power loss at all power division states. If $V_{C1}$ is not equal to $V_{C2}$, there will still be power division, but it will be accompanied by attenuation through reflection back to the input port and absorption at the terminated isolated port. The variable ratio power divider 50 may be realized in any planar or coaxial transmission medium, including but not limited to microstrip, stripline, and monolithic medias.

The reciprocity theorem states that the transfer function of a reciprocal coupler is unchanged when the position of the generator and load are interchanged. See for example, *Electromagnetic Waves and Radiating Systems* published by Prentice-Hall, 1962, in particular Section 10.09. Thus. the variable ratio power divider 50 can also operate as a power combiner, by changing the ports 72 and 74 from output ports to input ports, with the combined power appearing at the port labeled input port in FIG. 4. In the power combiner mode, however, only the portion of the input signals of equal magnitude and antiphase phase (i.e., 180° out of phase) are summed to the "input" port (i.e., the reciprocal of the phase relation in the power divider operation).

In the embodiment of FIG. 4 there is optimum performance over a relatively narrow (approximately 10%) bandwidth, but in other embodiments additional resonant circuits can be added in parallel to the resonant circuits 64 and 66 to provide broader bandwidth operation. These circuits would be similar to the resonant circuits 64 and 66, but would have component values providing a different resonant frequency for the same control voltage. Since each resonant circuit has one resonant frequency peak, stringing several of these resonant circuits together provides several resonant peaks and thus broader bandwidth operation. Additional elements can also be added in series with the elements in the resonant circuits 64 and 66.

Figure 5:
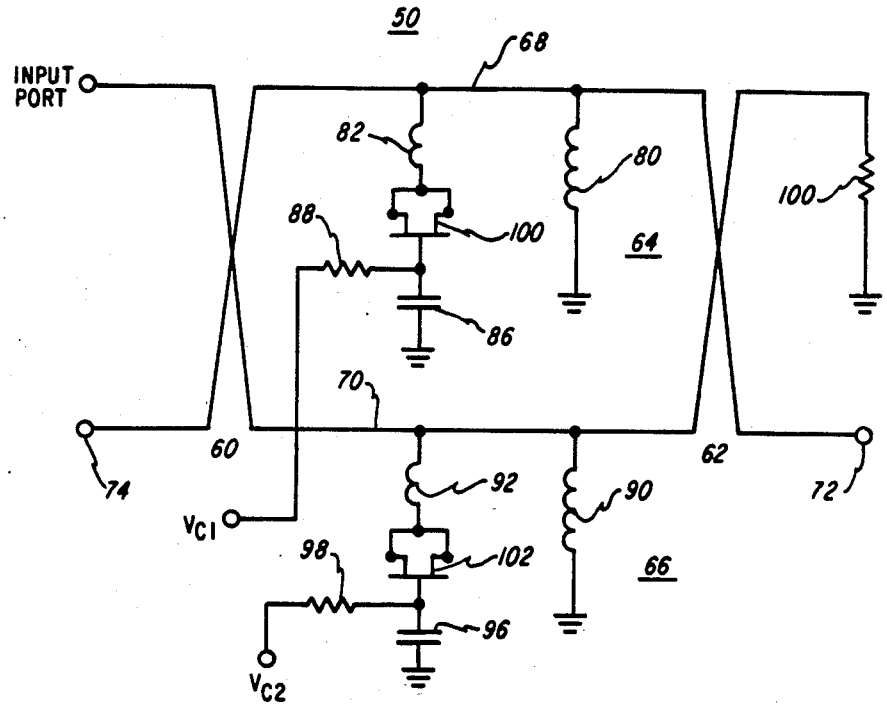

FIG. 5 illustrates another embodiment of the variable ratio power divider 50 wherein the varactors B4 and 94 have been replaced by field effect transistors 100 and 102, respectively.

Figure 6:
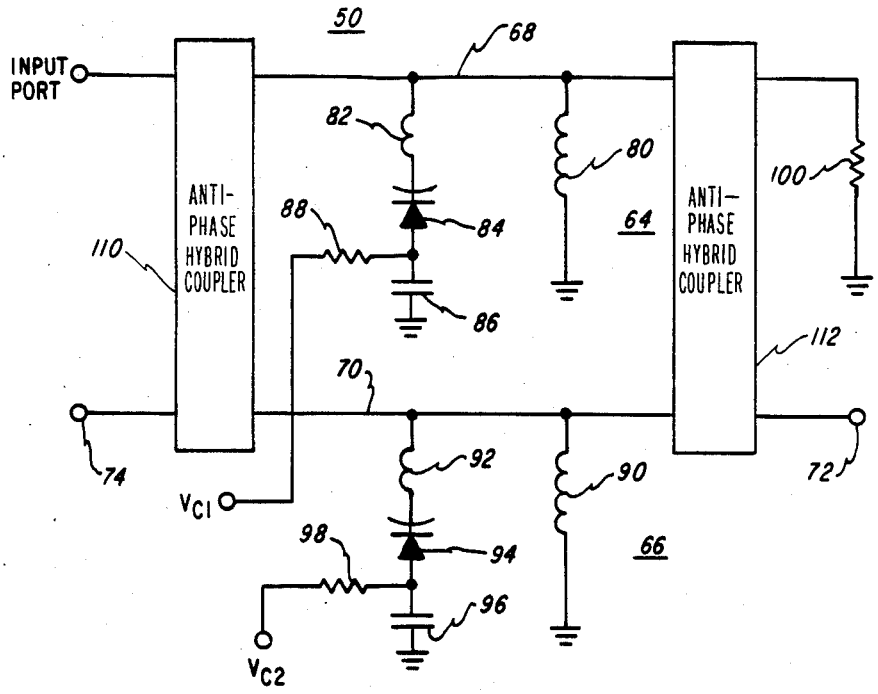
FIG. 6 illustrates a third embodiment of the variable ratio power divider of the present invention.

FIG. 6 illustrates another embodiment of the variable ratio power divider 50 wherein the 3 dB hybrid cou-

VARIABLE RATIO POWER DIVIDER/COMBINER

FIELD OF THE INVENTION

This invention relates to power divider networks having a planar configuration for providing variable dividing/combing power ratios.

BACKGROUND OF THE INVENTION

In certain types of signal transmission systems, such as communications satellites, it is necessary to couple energy from a plurality of microwave signal sources to a single output port. Waveguide-based systems use various types of variable ratio power combiners that operate essentially as variable directional couplers providing selective coupling from zero to 100%. One such waveguide-type variable ratio power combiner is described and claimed in U.S. Pat. No. 4,492,938, which is assigned to the assignee of the present invention. This device provides the variable combining feature by mechanical adjustment of its waveguide components.

Recent advances in solid state technology have made it possible to replace, at some frequencies, vacuum tube high-power amplifiers with solid-state high power amplifiers. Although the solid state high power amplifiers provide higher reliability, they have sharply limited power handling capabilities, compared to vacuum tube high power amplifiers. Accordingly, power combiner circuits are used with the solid state devices to provide suitably high levels of power transmission.

Figure 1:
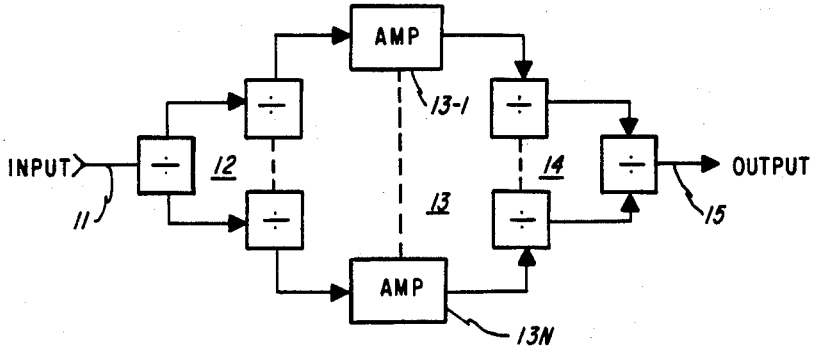
FIG. 1 (PRIOR ART)
FIG. 1 depicts a solid state high power amplifier incorporating power combiners therein.

A schematic block diagram of a typical solid-state high power amplifier is shown in FIG. 1 as containing the following principal elements: a power divider section 12, a solid state amplifier section 13, and a power combiner section 14, coupled in cascade between an input port 11 and an output port 15. In general, the power combiner section 14 is a replica of the power divider section 12, except for higher power physical considerations. The number of individual amplifier modules 13-1 . . . 13-N will depend upon the capacity of a single module 13-i, the total output required, and the losses through the power divider section 12 and the power combiner section 14. There are many types of signalling and coupling hardware that can be used for the divider and combiner sections illustrated in FIG. 1. Included among these couplings schemes are stripline networks using Wilkinson type dividers, waveguide or coaxial networks using 3 dB quad couplers, ratio combiners having a center coaxial probe, and ratio coaxial feed probes contained within a parallel plate structure.

Figure 2:
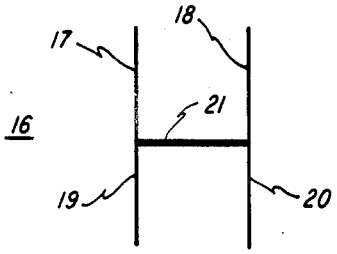
FIG. 2 (PRIOR ART)
FIGS. 2 and 3 depict prior art hybrid combiners/dividers.

A prior art 3 dB hybrid directional coupler 16 is illustrated in FIG. 2; the coupler 16 can be implemented in microstrip or stripline. When a signal is provided as an input to a egment 17, the segment 18 is isolated, i.e., no part of the input signal appears at the isolated segment 18. A segment 19 carries one-half of the input signal from the segment 17 with a relative output phase of 0° and a segment 20 carries one-half of the input signal with a relative output phase of 90°. As can be seen, a connecting segment 21 bridges the segments 17 and 19 with the segments 18 and 20.

The prior art microwave power dividers, such as those mentioned above, are individually designed and constructed to achieve specific fixed divisions of the input microwave power at the output ports. Once one of these microwave power dividers has been designed and constructed to achieve a specific power split, it cannot later be easily changed to give a different power split. For example, if a magic T or hybrid coupler has been designed and constructed to achieve a 3/3 dB power split in which one-half of the input power is seen at each of the two output ports, it cannot thereafter be changed to achieve a 6/1.25 dB, in which one-fourth and three-fourths of the input power is seen at the two output ports.

Figure 3:
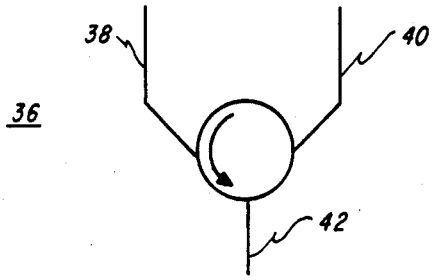
FIG. 3 (PRIOR ART)

A prior art circulator 36, which can provide limited power combining/dividing, is illustrated in FIG. 3. The circulator 36 has 3 ports designated by reference characters 38, 40, and 42. The application of a static external magnetic field allows an input signal at one port to be reflected to an output at a different port. For example, when a signal is input to port 38 the output signal appears at port 42, and port 40 is isolated. When a signal is provided as an input to the port 42, the output signal appears at the port 40 and port 38 is isolated. Lastly, when a signal is provided as in input to port 40, the output signal appears at port 38, and port 42 is isolated. The circulator 36 is not a power-efficient device, but it can be electromagnetically adjusted to provide limited power division among the ports. Limited power division around a nominal value can be obtained by adjusting the magnetic field intensity orthogonal to the circulator substrate. Power division can also be accomplished by connecting a variable impedance between one port of the circulator 36 and ground. Changing this impedance value will change the power ratios.

SUMMARY OF THE INVENTION

The objective of the present invention is to provide a monolithic power divider (or combiner) that provides variable power division, thus overcoming the disadvantages of the prior art variable ratio power dividers discussed above. The variable ratio power divider of the present invention is controlled by a control voltage that varies the impedance of a resonant inductor-varactor circuit. The impedance of the resonant circuit is adjustable to impedances ranging from a short circuit to an open circuit to split the input power between the two output ports.

BRIEF DESCRIPTION OF THE DRAWINGS

The present invention can be more easily understood, and the further advantages and uses thereof more readily apparent, when considered in view of the description of the preferred embodiments and the following figures in which:

FIG. 1 depicts a solid state high power amplifier incorporating power combiners therein;

FIGS. 2 and 3 depict prior art hybrid combiners/dividers;

FIGS. 4 and 5 illustrate, in schematic form, two embodiments of the variable ratio power divider of the present invention; and FIG. 6 illustrates a third embodiment of the variable ratio power divider of the present invention.

DESCRIPTION OF THE PREFERRED EMBODIMENTS

FIG. 4 illustrates a variable ratio power divider 50 constructed according to the teachings of the present invention. The variable ratio power divider 50 includes two resonant circuits designated by reference characters 64 and 66. The signal provided at the input port is divided by a quadrature 3 dB hybrid coupler 60 so that one-half of the signal (at a relative 0° phase angle) appears on a signal conductor 68 and one-half (at a relative 90° phase angle) appears on a signal conductor 70. When the resonant circuits 64 and 66 are in parallel resonance both appear as open circuits causing the signals on the signal conductors 68 and 70 to be combined in a quadrature 3 dB hybrid coupler 62, with the resultant signal appearing at a port 72, with a phase angle of −180° relative to the input signal. Although the couplers 60 and 62 are shown as quadrature 3 dB hybrid couplers, any equal-power split coupler can be used in place thereof. For example, antiphase 3 dB hybrid couplers, which provide equal power division but with relative phases of 0° and 180°, can be substituted.

When both the resonant circuits 64 and 66 are in series resonance, each appears as a short circuit between ground and the conductors 68 and 70, respectively, and thus all the power from the input port is reflected back to a port 74. In this condition the resultant signal at the port 74 is 180° out of phase with respect to the signal at the input port. When the impedances of the resonant circuits 64 and 66 are between a short circuit and an open circuit there is a division of power, as determined by the impedances of the resonant circuits 64 and 66 relative to the characteristic impedance of the signal conductors 68 and 70. Thus, a portion of the power appears at the output port 72 and a portion of the power appears at the output port 74.

The resonant circuit 64 comprises a series connection of an inductor 82, a varactor, 84, and a capacitor 86. This series combination is connected between the signal conductor 68 and ground and is also connected in parallel with an inductor 80. The connection point between the varactor 84 and the capacitor 86 is connected to a control voltage $V_{C1}$ through a resistor 88. The inductor 82 has a small inductance relative to the inductor 80., in one embodiment the inductor 82 is a parasitic inductance of the varactor 84. When the capacitance of the varactor 84 is large it resonates with the inductor 82 to create a series resonant short circuit. When the capacitance of the varactor 84 is small a parallel resonant circuit is created with the inductor 80, creating an open circuit. The control voltage $V_{C1}$ is applied to the varactor 84 to control the capacitance thereof and thereby create the open or the short circuit (or any impedance between these extremes) as discussed above.

The capacitor 86 is of a relatively large value to provide dc blocking, but appears as a low impedance, compared to the capacitor 84, at the high frequencies at which the variable ratio power divider operates. Thus, the capacitor 86 does not substantially affect the operation of the resonant circuit 64.

The resonant circuit 66 includes an inductor 90 connected between the signal conductor 70 and ground. The resonant circuit 66 also includes a series combination of an inductor 92, a varactor 94, and a capacitor 96, connected between the signal conductor 70 and ground. The connection point between the varactor 94 and the capacitor 96 is connected to a control voltage $V_{C2}$ via a resistor 98. The resonant circuit 66 functions identically to the resonant circuit 64.

The variable ratio power divider 50 also includes a load resistor 100 that is matched to the transmission line (i.e., the signal conductors 68 and 70) impedance, which in one embodiment is 50 ohms. The resistors 88 and 98 in addition to serving as dc bias resistors, also provide RF blocking into the control voltage source. In one embodiment the resistors 88 and 98 are 2,000 ohms, but in another embodiment RF chokes can also be substituted. Also in one embodiment, the inductors 80 and 90 can be formed from a length of high impedance transmission line, rather than using a discrete inductor. This feature enables implementation of the variable ratio power divider in monolithic form.

When the inductor 82 and the varactor 84 are in series resonance (the inductor 80 has no effect under this condition) the signal conductor 6B appears as a short circuit and thus no energy is propagated beyond the resonant circuit 64. Instead, the energy is reflected back to the quadrature 3 dB hybrid 60 and thus to the port 74. When the varactor 84 and the inductor 80 are in parallel resonance the resonant circuit 64 appears as an open and all the power propagating on the signal conductor 68 is passed to the 3 db hybrid coupler 62, and thus to the port 72. Because the inductor 82 has a small inductance compared with the indicator 84, the former inductance can be disregarded in this situation. Operation of the resonant circuits 64 and 66 at an intermediate impedance value provides the mechanism by which the ratio between the output power at the ports 72 and 74 is varied. Control of the resonant circuits 64 and 66 is accomplished separately (with $V_{C1}$ and $V_{C2}$) and with virtually no dc power consumption. For optimum performance $V_{C1}=V_{C2}$ and the resonant circuits 64 and 66 are matched. This provides low power loss at all power division states. If $V_{C1}$ is not equal to $V_{C2}$, there will still be power division, but it will be accompanied by attenuation through reflection back to the input port and absorption at the terminated isolated port. The variable ratio power divider 50 may be realized in any planar or coaxial transmission medium, including but not limited to microstrip, stripline, and monolithic medias.

The reciprocity theorem states that the transfer function of a reciprocal coupler is unchanged when the position of the generator and load are interchanged. See for example, *Electromagnetic Waves and Radiating Systems* published by Prentice-Hall, 1962, in particular Section 10.09. Thus. the variable ratio power divider 50 can also operate as a power combiner, by changing the ports 72 and 74 from output ports to input ports, with the combined power appearing at the port labeled input port in FIG. 4. In the power combiner mode, however, only the portion of the input signals of equal magnitude and antiphase phase (i.e., 180° out of phase) are summed to the "input" port (i.e., the reciprocal of the phase relation in the power divider operation).

In the embodiment of FIG. 4 there is optimum performance over a relatively narrow (approximately 10%) bandwidth, but in other embodiments additional resonant circuits can be added in parallel to the resonant circuits 64 and 66 to provide broader bandwidth operation. These circuits would be similar to the resonant circuits 64 and 66, but would have component values providing a different resonant frequency for the same control voltage. Since each resonant circuit has one resonant frequency peak, stringing several of these resonant circuits together provides several resonant peaks and thus broader bandwidth operation. Additional elements can also be added in series with the elements in the resonant circuits 64 and 66.

FIG. 5 illustrates another embodiment of the variable ratio power divider 50 wherein the varactors B4 and 94 have been replaced by field effect transistors 100 and 102, respectively.

FIG. 6 illustrates another embodiment of the variable ratio power divider 50 wherein the 3 dB hybrid couplers 60 and 62 have been replaced by antiphase couplers 110 and 112. These antiphase couplers 110 and 112 function in much the same way as the 3 dB hybrid couplers 60 and 62, except the former provide 180 degrees of phase shift, rather than the 90 degrees of phase shift provided by the latter.

Although several embodiments in accordance with the present invention have been shown and described, it is understood that the same is not limited thereto but is susceptible of numerous changes and modifications as known to a person skilled in the art, and I therefore do not wish to be limited to the details shown and described herein, but intend to cover all such changes and modifications as are obvious to one of ordinary skill in the art.

What is claimed is:

1. A variable ratio power divider comprising:

an input port adapted for receiving an input signal;

a first and a second output port for receiving a portion of the onput signal supplied at said input port;

a first and a second equal-split coupler, each having four terminals and an intervening path segments, and wherein said first and said second couplers are serially connected such that first and second terminals of said first coupler are connected to first and second terminals of said second coupler at first and second junctions. respectively;

wherein the third terminal of said firts coupler functions as said input port, and wherein the fourth terminal thereof functions as said first output port, and wherein the thrid terminal of said second coupler functions as siad second output port, and wherein the fourth terminal thereof is terminated with a load;

a first resonant circuit connected to said first junction;

a second resonant circuit connected to said second junction;

means for providing a control signal to each of said first and said second resonant circuits;

wherein the impedance of said first and second resonant circuits is variable between an open and a short under control of said control sinal applied thereto, such that a fist portion of said input signal is output at said first output port, and a second portion of said input signal is output at said second output port.

2. The variable ratio power divider of claim 1 wherein the first and the second equal-split couplers are quadrature 3 db hybrid couplers.

3. The variable ratio power divider of claim 1 wherein the first and the second equal-split couplers are antiphase 3 dB hybrid couplers.

4. The variable ratio power divider of claim 1 wherein the control signal is established to place the first and the second resonant circuits in parallel resonance, and wherein the input signal is output at the second output port.

5. The variable ratio power divider of claim 1 wherein the control signal is established to place the first and the second resonant circuits in series resonance, and wherein the input signal is output at the first output port.

6. The variable ratio power divider of claim 1 wherein the first esonant circuit ineludes a series arrangement of a first inductor and a variable capacitor and a second inductor connected in parallel with said arrangement, wherein the control signal control the capitance of said variable capacitor, and wherein the first resonant circuit is connected between the transmission path and ground.

7. The variable ratio power divider of claim 6 wherein the variable capacitor is a varactor.

8. The variable ratio power divider of claim 6 wherein the variable capacitor is a field effect transistor.

9. The variable ratio power divider of claim 1 wherein the second resonant circuit includes a series arrangement of a first inductor, a variable capacitor, and a second inductor connected in parallel with said series arrangement, wherein the control signal controls the capacitance of said variable capacitor, and wherein the second resonant circuit is connected between the transmission path and ground.

10. The variable ratio power divider of claim 9 wherein the variable capacitor is a varactor.

11. The variable ratio power divider of claim 9 wherein the variable capacitor is a field effect transistor.

12. A variable ratio divider comprising:

an input port adapted for receiving an input signal;

a plurality of output ports for receiving a portion of the input signal supplied at said input port;

a first and a second equal-split coupler, each coupler having four terminals, and wherein said first and said second couplers are serially connected such that first and second terminals of said first coupler are connected to first and second terminals of said second coupler at first and second junctions, respectively, and wherein the third terminal of said first coupler forms said input port, and wherein the fourth terminal thereof forms one of the plurality output ports, and wherein the third terminal of said second coupler forms another one of the plurality of output ports, an wherein the fourth terminal thereof is terminated with a load;

a plurality of resonant circuits wherein a first resonant circuit from the plurality of resonant circuits is connected to said first junction, and where a second resonant circuit from the plurality of resonant circuits is connected to said second junction;

means for providing a control signal to each of said plurality of resonant circuits;

wherein the impedance of each of said plurality of resonant circuits is controlled by variation of said control signal thereto, such that aportion of said input signal is output at each of said plurality of output ports.

13. A variable ratio power divider of claim 12 wherein the first and the second equal-split couplers are quadrature 3 dB hybrid couplers.

14. The variable ratio power divider of claim 12 wherein the first and the second equal-split couplers are antiphase 3 dB hybrid couplers.

15. A variable ratio power combiner comprising:

an output port adapted for supplying an output signal;

a plurality of input ports adapted for receiving an input signal to be supplied to said output port;

a first and a second equal-split coupler, each having four terminals;

and wherein said first and said second couplers are serially connected such that first and second terminals of said first coupler are connected to first and second terminals of said second coupler at first and second junctions, respectively, and wherein the third terminal of said first coupler forms said output port, and wherein the fourth terminal thereof forms one of the plurality input ports, and wherein the third terminal of said second coupler forms another one of the plurality of input ports, and wherein the fourth terminal thereof is terminated with a load, and wherein a first resonant circuit is connected to said first junction, and wherein a second resonant circuit is connected to said second junction;

means for providing a control signal to each of said resonant circuits;

wherein the impedance of each of said plurality resonant circuits is varied by application of said control signal thereto, such that a portion of said input signal is supplied from each of said plurality of input ports to said output port.

16. The variable ratio power divider of claim 15 wherein the first and second equal-split couplers are quadrature 3 dB hybrid couplers.

17. The variable ratio power divider of claim 15 wherein the first and the second equal-split couplers are antiphase 3 db hybrid couplers.

* * * * *